US005950897A

United States Patent [19]

Kao

[11] Patent Number: 5,950,897

[45] Date of Patent: Sep. 14, 1999

[54] STORAGE BOX

[76] Inventor: Cheng-Hsien Kao, 2, Alley 1, Lane 29, Sec. 2 Pei-Shin Rd., Shin-Tien, Taiwan

[21] Appl. No.: 09/104,217

[22] Filed: Jun. 25, 1998

[51] Int. Cl.[6] ..... A45C 1/04

[52] U.S. Cl. ..... 224/666; 224/240; 224/242; 224/268; 224/269; 224/271; 224/668

[58] Field of Search ..... 224/240, 241, 224/242, 268, 269, 270, 271, 272, 904, 912, 920, 931, 668, 666, 679

[56] References Cited

U.S. PATENT DOCUMENTS

| | | | |
|---|---|---|---|
| 4,044,933 | 8/1977 | Artz | 224/666 |
| 4,113,156 | 9/1978 | Brito | 224/666 |
| 4,479,596 | 10/1984 | Swanson | 224/236 |
| 4,903,745 | 2/1990 | Roman | 150/134 |

*Primary Examiner*—Allan N. Shoap
*Assistant Examiner*—Maerene W. Brevard
*Attorney, Agent, or Firm*—Varndell & Varndell, PLLC

[57] ABSTRACT

A storage box structure for hanging on a waist belt, which includes an elongated box body having an inner plate and a partition plate attached to the inner plate. An opening is provided in the inner plate and a hook passes through the opening. The hook is connected to one end of a rope that passes through a hole in the bottom of the storage box and extends from the interior of the box body to the outside of the box body. The other end of the rope is secured to the bottom of the box body by a snap. The box body also has provided with an insulation slot formed on a back wall thereof that can receive the free end of the hook. Engagement and disengagement of the hook with the insertion slot can be controlled by and the rope. The storage box can be firmly attached to a waist belt without dropping and without taking off the waist belt. In addition, when in use on a waist belt, the storage box can freely move up and down for accommodating a user's movements without causing any discomfort to the user.

4 Claims, 5 Drawing Sheets

STORAGE BOX

BACKGROUND OF THE INVENTION (a). Field of the Invention

The present invention relates to a storage box, especially to an elongated storage box fit for being attached to a waist belt (b). Description of the Prior Art Conventional storage boxes, such as those used for glasses or handy phones, are usually provided with two penetrated openings on the back. Users pass their waist belts through the two openings to attach the storage box to the belt and then pass the belt through the belt loops on a pair of pants. Such a design is often seen in a glasses' box. However, if the user wants to take off the storage box he must remove the belt from his pants first and then detach the box from the belt. Thus the conventional structure brings users inconvenience in wearing. Besides, such a storage box can not move up and down when it hangs on the belt and so it will press against users' bodies and cause users uncomfortable when users change their position from standing to sitting.

Another prior art design adopts a spring clip disposed on the back of the box. Such an arrangement often can be found on a prior art storage box for a handy phone. Although the storage box can be easily attached to a waist belt by a spring clip without the necessity of taking off the belt, it is very easy to drop the storage box by mistake due to mutual squeezes between the box and wearer's body during walking, running, or alternating standing and sitting. Hence it can not reach a secure effect.

SUMMARY OF THE INVENTION

The primary object of the invention is to provide a storage box structure that is fit for being attached to a waist belt and in which an elongated box body is provided on its internal wall surface with an inner plate and a partition plate and a hook extends from the exterior of the box body into the interior and is fixed by a pulling rope. The pulling rope passes through the bottom of the box from the interior to reach the outside and is secured to the underside of the bottom by a snap. Users make use of the pulling rope to manipulate the engagement and disengagement of the hook with an insertion slot. The effect of the invention not only can keep a storage box firmly hung on a belt but also can provide convenience in use. A user can detach it without taking off his belt The second object of the invention is to provide a storage box structure in which the hook movably attached to the elongated box body is a slender flat plate having an end fit for extending into an insertion slot disposed on the back side of the box body. Therefore the storage box attached to a waist belt by the hook can freely move up and down. Users, either in a standing pose or in a sitting pose, can adjust the position of the box at will to make themselves feel comfortable.

DETAILED DESCRIPTION OF THE PREFERRED EMBODIMENTS

Figure 1:
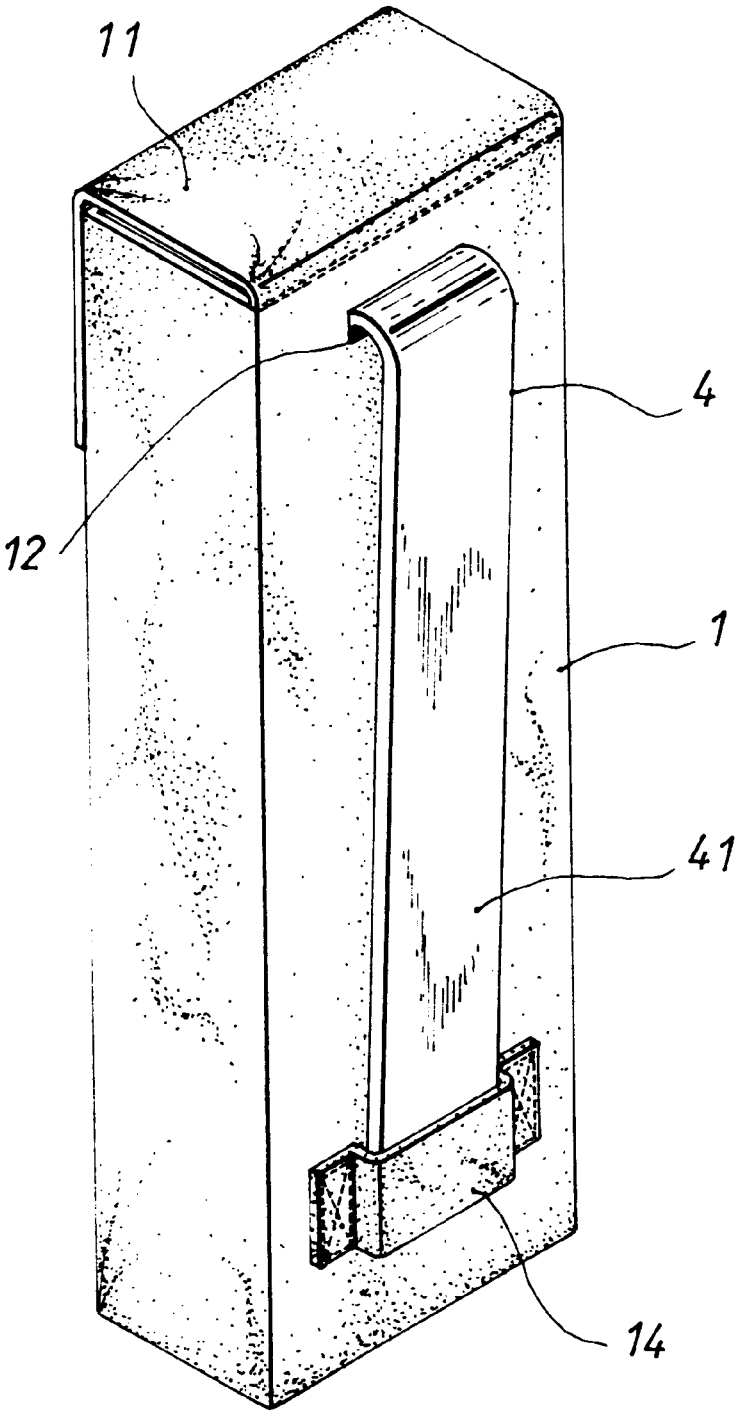
FIG. 1 is a perspective view of a storage box according to the invention.

As shown in FIG. 1, a storage box according to the invention comprises a box body 1, an inner plate 2, a partition plate 3, a hook 4, and a strap 5.

The box body 1 is an upright elongated container fitted at the upper end with an openable cover 11, provided on the back side near the upper end with a through opening 12, and equipped on the back side near the lower end with an insertion slot 13, which is formed by stitching a U-shaped plate 14 to the box body. The box body further has an elongated opening 15 formed on the bottom. The ball side 16 of a snap is disposed near the elongated opening 15.

Figure 2:
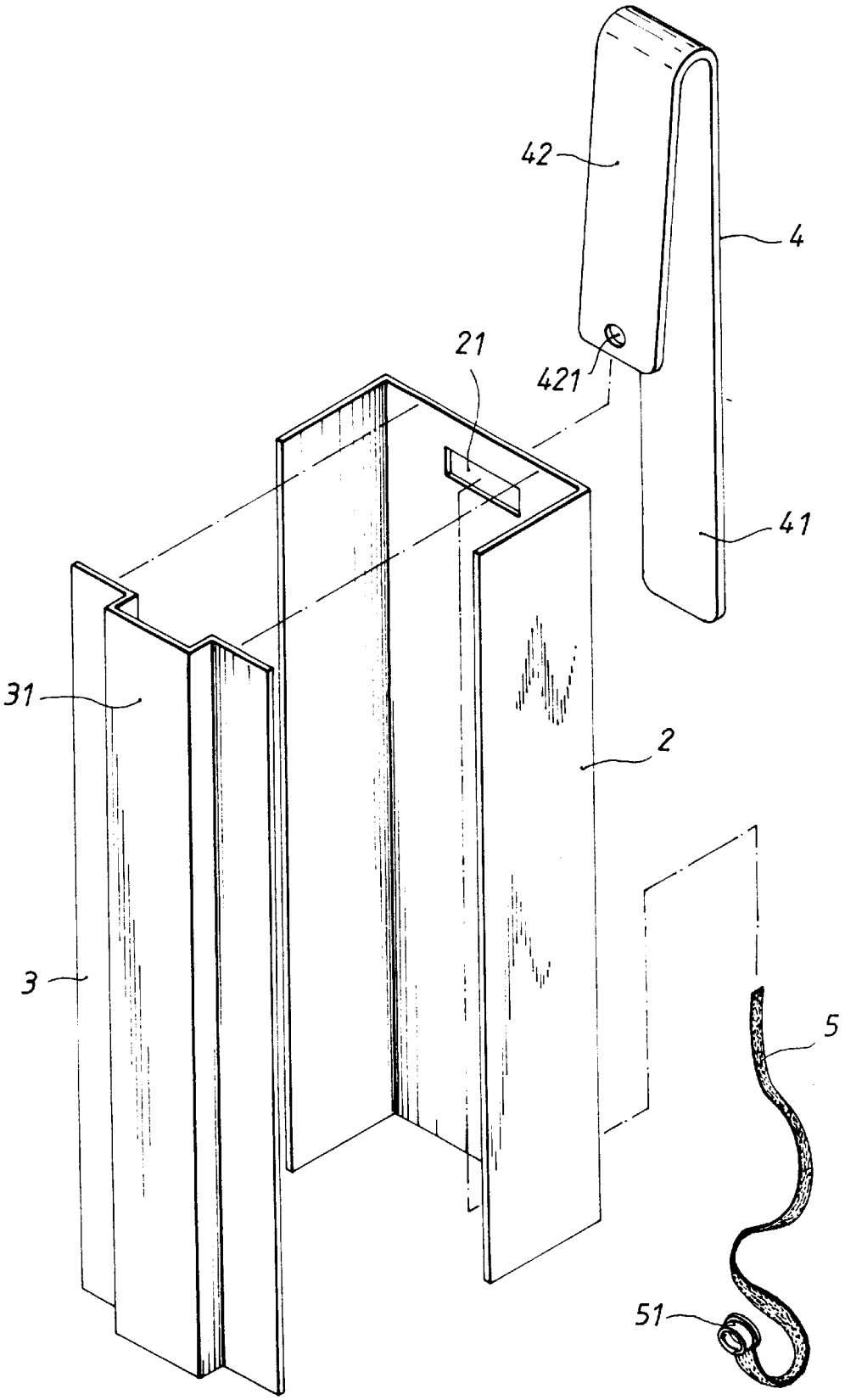
FIG. 2 is an exploded view showing constituent parts of the storage box of FIG. 1.

The inner plate 2 shown in FIG. 2 is a U-shaped hard plate. It is attached to the internal wall surface of the box body 1. The inner plate 2 is further provided with a through hole 21 near the upper end at a position corresponding to the through opening 12 of the box body 1.

Figure 4:
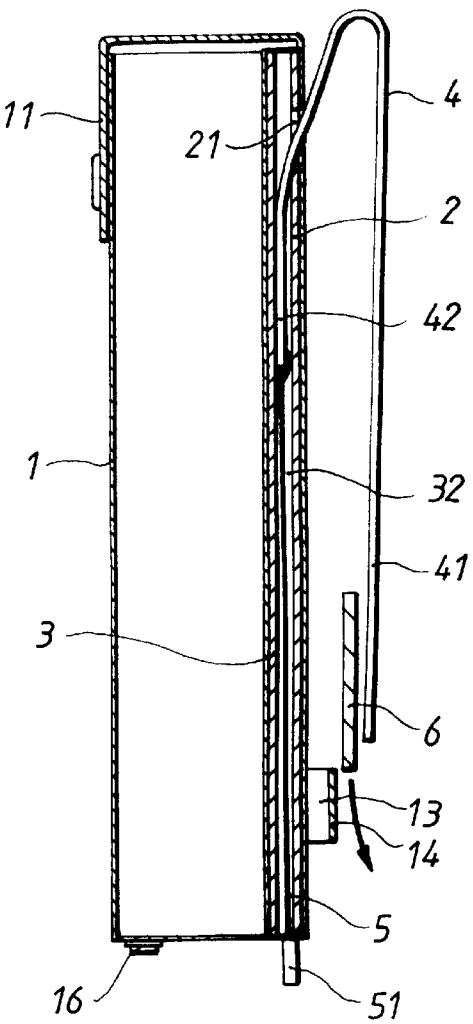
FIG. 4 is a cross sectional view of the storage box in which the hook is drawn out of the insertion slot.
Figure 3:
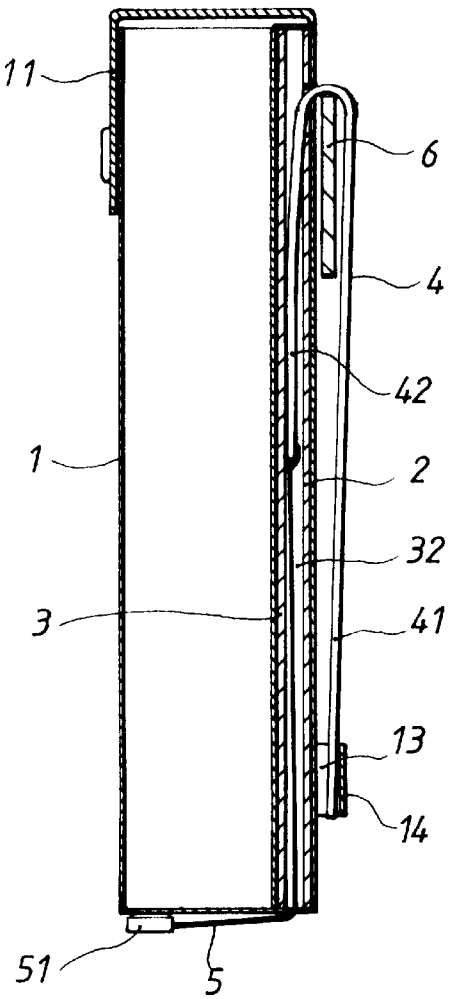
FIG. 3 is a cross sectional view of the storage box in which the hook resides in an insertion slot.
Figure 5:
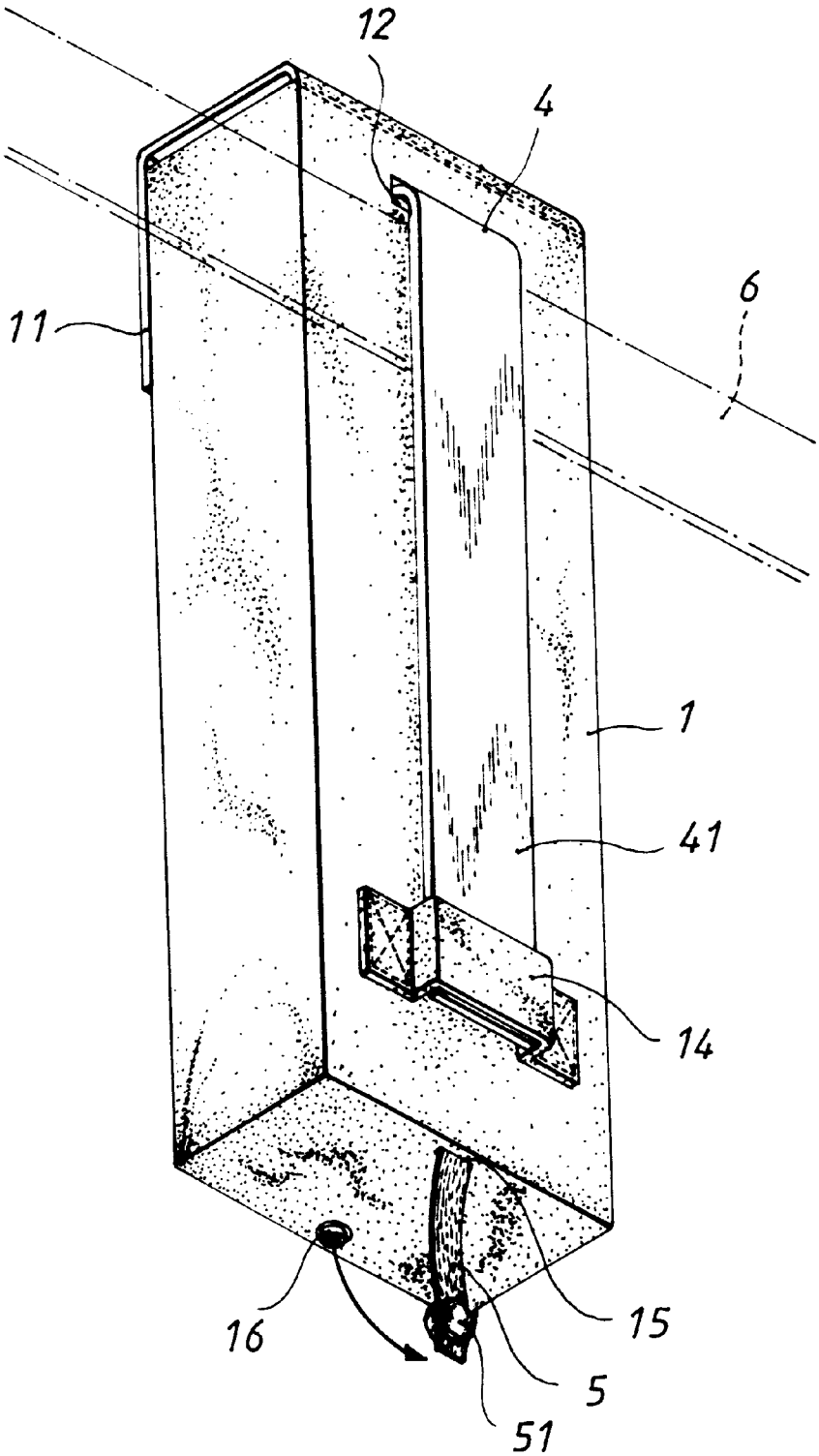
FIG. 5 is a schematic view schematically indicating how to attach a storage box of the invention to a waist belt.

Stuck to the inner surface of the inner plate 2 is a partition plate 3 having a raised middle section 31, which in conjunction with the inner plate 2 forms a compartment 32 as shown in FIGS. 3 and 4.

The hook 4 is a slender flat plate having a straight flat portion 41 and a bent end portion 42 turned almost 180 degrees from its original orientation. The bent end portion 42 of the hook 4 is shorter than the flat portion 41 and is sized to be fit for extension through the opening 12 of the box body 1 and the hole 21 of the inner plate 21. With this arrangement, the hook 4 can be attached to the box body 1, with the bent end portion 42 extending into the box body and the flat portion 41 passing through the insertion slot 13 on the back side of the box body 1. The bent end portion 42 has an aperture 421 disposed near the end edge and through which a rope 5 is attached to the hook 4.

The rope 5 has flexibility like a knitted strap, with one end passing through the aperture 421 of the hook 4 and the other end provided with the socket side 51 of a snap. The rope 5 passes through the elongated opening 15 on the bottom of the box body 1 and extends to the outside from the interior of the box body 1, with the socket side 51 snapped on the ball side 16. The attachment of the socket side 51 to the ball side 16 pulls the hook 4 downwards to keep the flat portion 41 of the hook 4 seated in the insertion slot 13 as shown in FIG. 3. When the pull force is removed, the hook 4 can be lifted to draw the flat portion 41 out of the slot 13 as shown in FIG. 4.

Figure 6:
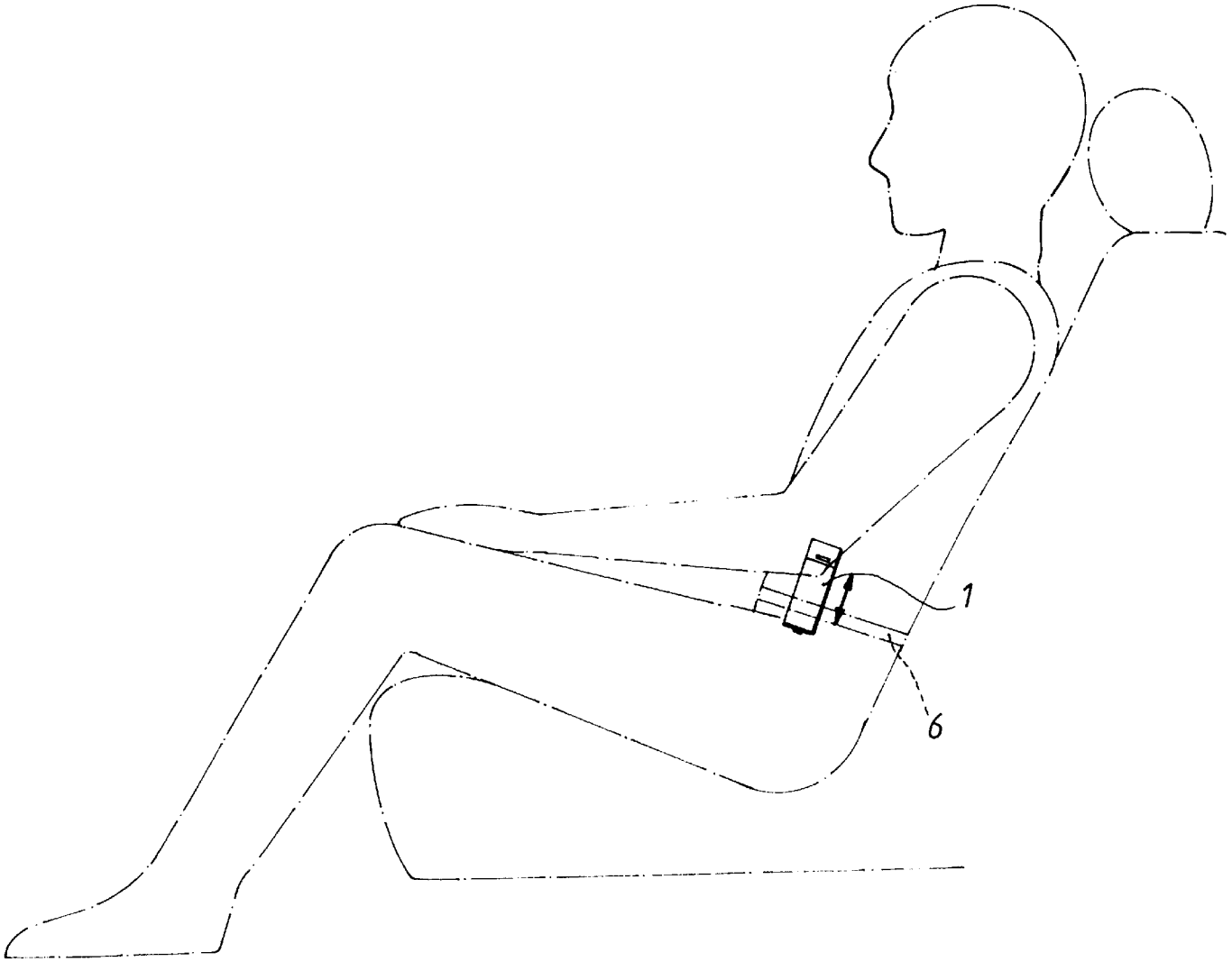
FIG. 6 shows the practice of a user's wearing a storage box of the invention.

According to the invention, when users want to attach the storage box to a waist belt 6, they make use of the engagement and disengagement of the snap (16, 51) to keep the hook 4 in the insertion slot 13 or release it. Thus the connection means not only can keep the storage box firmly attached to the belt 6 but also can provide convenience in detaching the box from a belt. In addition, when the box is hanging on the belt 6, it is free to move up and down because the longer flat portion 41 of the hook 4 allows up-and-down movements of the box. Especially when users change from a standing posture to a sitting posture as shown in FIG. 6, the box on the belt 6 can automatically move upwards. Therefore it will not bring any discomfort to users.

What is claimed is:

1. A storage box comprising a box body, an inner plate, a partition plate, a hook, and a pulling rope, the box body is an upright elongated container having an upper end with an openable cover, a back side with an opening adjacent the upper end, a lower end of the back side having an insertion slot, and the box body further has a bottom with an elongated opening, and a ball of a snap is arranged near the elongated opening, the inner plate is a U-shaped plate attached to an internal wall surface of the box body and is provided with a hole near the upper end at a position corresponding to the opening of the box body, the partition plate is secured to the inner plate to form a compartment between the partition plate and the inner plate, the hook has a bent end portion extending through both the opening of the box body and the hole of the inner plate and a straight flat portion exposed outside the box and extending into the insertion slot formed on the back of the box body, an aperture is arranged in the bent end portion through which a rope is attached to the hook, and the rope has one end tied to the aperture of the hook and another end provided with a socket of a snap, the rope extending from an interior of the box body to the outside of the box body through the elongated opening on the bottom of the box body, and the rope is fixed in place by snapping the ball into the socket, wherein engagement of the socket with the ball pulls the hook downward to urge the flat portion of the hook to fall into the insertion slot and disengagement of the socket from the ball allows the hook to escape from confinement of the insertion slot.

2. The storage box as claimed in claim 1, in which the insertion slot formed on the lower end of the back side of the box body is defined by a U-shaped plate stitched to the box body.

3. The storage box as claimed in claim 1, in which the partition plate has a raised middle section which in conjunction with the inner plate forms the compartment.

4. The storage box as claimed in claim 1, in which the hook has a straight flat portion, and the flat portion is longer than the bent end portion.

* * * * *